US009629771B2

(12) United States Patent
Knowlton

(10) Patent No.: US 9,629,771 B2
(45) Date of Patent: Apr. 25, 2017

(54) URINAL

(71) Applicant: Jayne E. Knowlton, Honeoye Falls, NY (US)

(72) Inventor: Jayne E. Knowlton, Honeoye Falls, NY (US)

( * ) Notice: Subject to any disclaimer, the term of this patent is extended or adjusted under 35 U.S.C. 154(b) by 192 days.

(21) Appl. No.: 14/477,032

(22) Filed: Sep. 4, 2014

(65) Prior Publication Data

US 2016/0067132 A1 Mar. 10, 2016

(51) Int. Cl.
*A61G 9/00* (2006.01)

(52) U.S. Cl.
CPC ..... *A61G 9/006* (2013.01); *A61G 2200/12* (2013.01)

(58) Field of Classification Search
CPC A61G 9/006; A61G 2200/11; A61G 2200/12; A61G 2200/13; A61G 2200/32; A61G 2200/10; A47K 11/12; A61F 5/44; A61F 5/451; A61F 5/453; A61F 5/455; A61F 5/4553; A61F 5/4556
USPC ..... 4/144.1–144.3
See application file for complete search history.

(56) References Cited

U.S. PATENT DOCUMENTS

| | | | | |
|---|---|---|---|---|
| 1,767,240 | A * | 6/1930 | Ivory | A61G 9/006 4/144.1 |
| 3,579,653 | A * | 5/1971 | Kuhn | A61G 9/006 4/144.2 |
| 4,665,571 | A | 5/1987 | Muccione | |
| 4,769,858 | A * | 9/1988 | Gamm | A61G 9/006 215/380 |
| 5,309,578 | A * | 5/1994 | Temple, Sr. | A47K 11/12 221/265 |
| 5,387,205 | A * | 2/1995 | Cummins | A61F 5/455 4/144.3 |
| 6,021,530 | A * | 2/2000 | Davis | A61G 9/006 4/144.1 |
| 6,070,275 | A | 6/2000 | Garlock | |
| 6,547,771 | B2 * | 4/2003 | Robertson | A61F 5/4556 4/144.1 |
| 2009/0158511 | A1 * | 6/2009 | Maze | A47K 11/12 4/144.1 |

* cited by examiner

*Primary Examiner* — J. Casimer Jacyna
(74) *Attorney, Agent, or Firm* — John M. Hammond; Patent Innovations LLC

(57) ABSTRACT

A urinal for use by a human patient, and a female patient in particular. The urinal is comprised of a bottom wall, posterior wall, anterior wall, and opposed first and second side walls that enclose a volume for receiving urine. A lower side wall portion of the first side wall may extend laterally outwardly from a lower region of an upper side wall portion of the first side wall, and a lower side wall portion of the second side wall may extend laterally outwardly from a lower region of an upper side wall portion of the second side wall. The lower side walls, anterior wall, and lower portion of a posterior wall define a major portion of the volume of the urinal.

15 Claims, 8 Drawing Sheets

URINAL

BACKGROUND

Technical Field

Vessels for receiving urine discharged from a human, and in particular, an ergonomic vessel for receiving urine from a female human.

Description of Related Art

Sick and injured women who are bedbound in hospitals, nursing homes, and in-home care have toileting needs. Additionally, bedridden hospital patients routinely have indwelling urinary catheters placed for various medical reasons. Examples include the conditions following trauma, surgery, or illness, any of which may result in a patient's physical inability to void his/her bladder or get out of bed.

30-40% of healthcare related infections have been attributed to the use of indwelling urinary catheters; see Klevens et al., "Estimating health care-associated infections and deaths in U.S. hospitals, 2002," *Public Health Rep.* 2007; 122(2):160-166. Additionally, being female is a risk factor for catheter associated infections; see Center for Disease Control, Wong et al., "Guidelines for prevention of catheter-associated urinary tract infections," p. 35, available at the following url: http://www.cdc.gov/ncidod/dhqp/pdf/guidelines/CAUTI_Guideline2009final.pdf.

Catheters should only be removed when patients are able to void and medically allowed to do so. Otherwise, an option is to extend the use of the catheter. This can be done with females when it is in their medical interest to have minimal movement. Bedridden females suffer a higher incidence of inappropriate urinary catheterization which increases their risk of urinary tract infections; see Apisarnthanarak et al., "Initial inappropriate urinary catheters use in a tertiary-care center: incidence, risk factors, and outcomes," *American Journal of Infection Control,* 35 (9): 594-9, 2007. This leads to a longer hospital length of stay. A higher cost of hospitalization due to the cost of antibiotics is a direct burden to a hospital, because the Centers for Medicare & Medicaid no longer reimburse for this expense; see Saint et al., Veterans Affairs Ann Arbor Healthcare System, *Annals of Internal Medicine,* 150 (12): 877-84, 2009.

In a nursing home setting, a compromised woman may need assistance with toileting, and even in using a urinal. In this situation, the patient may not be fully independent in use of the urinal, yet is able to avoid the indignity of a diaper or the experience of using a bedpan. The current in-bed options for females are limited. The need for a safe, effective, and comfortable urinal for females is indicated by the persistent frequency of bathroom related falls. Trying to get to the bathroom is a common reason given for a patient attempting to get out of bed with inadequate assistance. Changing to an external catheter (male only is routine), applying an adult diaper, or using a bedpan are possible options. Having an elderly woman void in a diaper over the course of a hospital stay increases the risk of long term incontinence.

The female urinals currently on the market that are known to the Applicant are not designed to capture urine effectively from a female who has limited mobility in the constrained setting of a bed. Using a diaper is undignified and messy, and care-giver dependent for donning, doffing and cleaning. The risk of skin irritation remains a problem. Using a bedpan also necessitates being rolled on and off of the bedpan by at least one caregiver. This ordeal is often painful, exhausting and degrading for the compromised patient.

Severely injured and obese patients can require up to three assistants for safe toileting care. Dependence on assistants often includes a waiting interval, which may lead to a loss of self-regulation, because too much time is needed to wait for the caregivers to finish their tasks safely, and gather other assistants and supplies.

The use of a simple bedpan is also unsatisfactory. Bedpans are essentially nothing more than catch basins, which collect urine after it has run down the woman's body to reach it. This is unpleasant and can lead to skin irritation. Moreover, rolling and placing a patient on a bedpan is physically demanding on the caregiver. Such demands may be avoided by the use of an effective urinal.

There remains a need for a urinal for use by females, and in particular, a urinal that is safe, effective, and comfortable for use by a female that is constrained to a supine position due to various medical circumstances.

SUMMARY

The present invention meets this need by providing a urinal having an ergonomic design that results in greater ease of use, greater user comfort, and complete capture of discharged urine, and allows for self-regulation. Additionally, use of the urinal significantly reduces the demand on caregiver assistants. The urinal is comprised of a bottom wall, posterior wall, anterior wall, and opposed first and second side walls that enclose a volume for receiving urine and that work cooperatively to provide the above advantages.

The bottom wall has a perimeter comprising a posterior part, opposed first and second side parts, and an anterior part. The posterior wall includes a bottom edge contiguous with the posterior part of the perimeter of the bottom wall and opposed first and second side edges. The anterior wall includes a bottom edge contiguous with the anterior part of the perimeter of the bottom wall, opposed first and second side edges, and an upper region proximate to a lower portion of an anterior opening.

The first side wall is comprised of a lower side wall portion including a bottom edge contiguous with the first side part of the perimeter of the bottom wall, an upper region, and an anterior edge contiguous with the first side edge of the anterior wall; an upper side wall portion, including a lower region contiguous with the upper region of the lower side wall portion of the first side wall, a top region, and an anterior edge forming a first side and top portion of the anterior opening; and a posterior edge contiguous with the first side edge of the posterior wall.

The second side wall is comprised of a lower side wall portion including a bottom edge contiguous with the second side part of the perimeter of the bottom wall, an upper region, and an anterior edge contiguous with the second side edge of the anterior wall; an upper side wall portion, including a lower region contiguous with the upper region of the lower side wall portion of the second side wall, a top region, and an anterior edge forming a second side and top portion of the anterior opening; and a posterior edge contiguous with the second side edge of the posterior wall.

In one aspect of the invention, the bottom wall, lower side wall portion of the first side wall, lower side wall portion of the second side wall, anterior wall, and a lower portion of the posterior wall define a major portion of the volume of the urinal. The major portion of the volume of the urinal may be at least 60 percent of the volume within the urinal. In certain embodiments, the lower side wall portion of the first side wall may extend laterally outwardly from the lower region of the upper side wall portion of the first side wall, and the lower side wall portion of the second side wall may extend laterally outwardly from the lower region of the upper side wall portion of the second side wall.

The anterior opening of the urinal may be comprised of a flange. A gasket may be fitted to the flange. The gasket may have a convex contour with respect to exterior the urinal. The convex contour may be dimensioned to seal against the urethral region of a female human using the urinal. In embodiments in which a gasket is not provided, the anterior opening may be comprised of the convex surface dimensioned to seal against the urethral region of a female human.

In certain embodiments, the anterior opening of the urinal defines a first plane intersecting a second plane defined by the bottom wall at an angle of less than 90 degrees. The angle may be between 65 degrees and 90 degrees.

The first and second side walls may each be comprised of a holding feature configured to engage with a human hand. In certain embodiments, the holding features are comprised of a plurality of ribs formed on the upper side wall portions of the first and second side walls. In other embodiments, the holding feature of the first side wall is comprised of a recess formed in the lower region of the upper side wall portion of the first side wall and the upper region of the lower side wall portion of the first side wall, and the holding feature of the second side wall is comprised of a recess formed in the lower region of the upper side wall portion of the second side wall and the upper region of the lower side wall portion of the second side wall. In yet other embodiments, the holding feature of the first side wall is comprised of a recess formed in a posterior region of the first side wall, and the holding feature of the second side wall is comprised of a recess formed in the posterior region of the second side wall.

In certain embodiments, the urinal may be further configured to hold in place a sterile bag for clean catch procedures. The urinal may be further comprised a removable cover sealingly engageable with the anterior opening. The urinal may include posterior regions of the first and second side walls that define a measurement volume within the urinal. In certain embodiments, the urinal may include electrodes embedded on the posterior regions of the first and second side walls. The electrodes may be configured to measure at least one property selected from pH, conductivity, glucose metabolism, and identification of and/or determination of the concentration of various natural metabolites, and synthetic metabolite components including drugs and the resulting byproducts of metabolism thereof. In other embodiments, the urinal may be further comprised of optical windows disposed in the posterior regions of the first and second side walls and defining an optical path through the measurement volume.

BRIEF DESCRIPTION OF THE DRAWINGS

The present disclosure will be provided with reference to the following drawings, in which like numerals refer to like elements, and in which.

Figure 1:
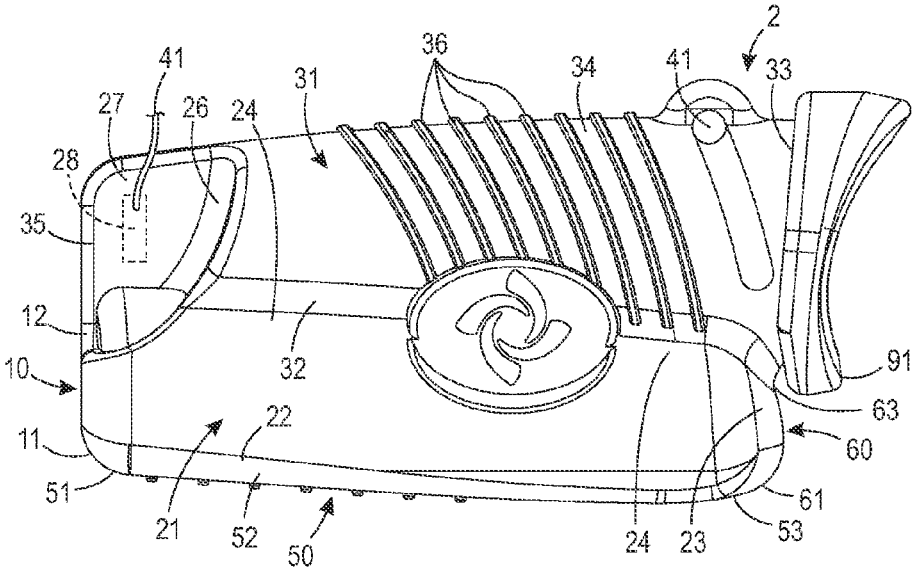
FIG. 1 is a left side elevation view of a urinal in accordance with the present disclosure.

The present invention will be described in connection with certain preferred embodiments. However, it is to be understood that there is no intent to limit the invention to the embodiments described. On the contrary, the intent is to cover all alternatives, modifications, and equivalents as may be included within the spirit and scope of the invention as defined by the appended claims.

DETAILED DESCRIPTION

For a general understanding of the present invention, reference is made to the drawings. In the drawings, like reference numerals have been used throughout to designate identical elements. In the following disclosure, certain features may be described with the adjectives "top," "upper," "bottom," "lower," "left," "right," etc. These adjectives are provided in the context of the orientation of the drawings, which is arbitrary. The description is not to be construed as limiting the instant urinal to use in a particular spatial orientation. The instant urinal may be used in orientations other than those shown and described herein.

Referring now to FIGS. 1-10, a urinal 2 in accordance with the present disclosure is depicted. The urinal 2 is comprised of a bottom wall 50, a posterior wall 10, an anterior wall 60, and opposed first and second side walls 20 and 70 that enclose a volume 4 for receiving urine and that work cooperatively to provide certain above advantages.

The bottom wall 50 has a perimeter comprising a posterior part 51, opposed first and second side parts 52 and 54, and an anterior part 53. The posterior wall 10 includes a bottom edge 11 contiguous with the posterior part 51 of the perimeter of the bottom wall 50, and opposed first and second side edges 12 and 14. It is to be understood that the term "edge" as used herein does not necessarily mean a sharply defined angular edge where two planar surfaces meet. Instead, the term "edge" as used herein is also meant to include radiused regions at the peripheries of walls that intersect with each other to form a smoothly curved transitional region between the intersecting walls. Such smoothly curved regions are advantageous for the manufacturing of the urinal using certain materials and by certain processes such as molding of plastic material.

The anterior wall 60 includes a bottom edge 61 contiguous with the anterior part 53 of the perimeter of the bottom wall, opposed first and second side edges 62 and 64, and an upper region 63 proximate to a lower portion 91 of an anterior opening 90.

The first side wall 20 is comprised of a lower side wall portion 21 and an upper side wall portion 31. The lower side wall portion 21 includes a bottom edge 22 contiguous with the first side part 52 of the perimeter of the bottom wall 50, an upper region 24, and an anterior edge 23 contiguous with the first side edge 62 of the anterior wall 60. The upper side wall portion 31 includes a lower region 32, a top region 34, an anterior edge 33, and a posterior edge 35. The lower region 32 is contiguous with the upper region 24 of the lower side wall portion 21. The anterior edge 33 forms a first side portion 92 and top portion 93 of the anterior opening 90. The posterior edge 35 is contiguous with the first side edge 12 of the posterior wall 10.

The second side wall 70 is comprised of a lower side wall portion 71 and an upper side wall portion 81. The lower side wall portion 71 includes a bottom edge 72 contiguous with the second side part 54 of the perimeter of the bottom wall 50, an upper region 74, and an anterior edge 73 contiguous with the second side edge 64 of the anterior wall 60. The upper side wall portion 81 includes a lower region 82, a top region 84, an anterior edge 83, and a posterior edge 85. The lower region 82 is contiguous with the upper region 74 of the lower side wall portion 71. The anterior edge 83 forms a second side portion 94 and top portion 95 of the anterior opening 90. The posterior edge 85 is contiguous with the second side edge 14 of the posterior wall 10.

In one aspect of the invention, the bottom wall 50, lower side wall portion 21 of the first side wall 20, lower side wall portion 71 of the second side wall 70, anterior wall 60, and a lower portion 15 of the posterior wall 10 define a major portion 5 of the volume 4 of the urinal. The major portion 5 (indicated by the dotted line shapes in FIGS. 7 and 8) of the volume 5 of the urinal may be at least 60 percent of the volume of the urinal. In certain embodiments, the lower side wall portion 21 of the first side wall 20 may extend laterally outwardly from the lower region 32 of the upper side wall portion 31 of the first side wall 20, and the lower side wall portion 71 of the second side wall 70 may extend laterally outwardly from the lower region 82 of the upper side wall portion 81 of the second side wall 70. Thus the lower portion of the volume 4 that is bounded by the lower side wall portions 21 and 71 has a larger cross-sectional area with respect to a transverse axis of the urinal 2 than the upper portion of the volume 4 that is bounded by the upper side wall portions 31 and 81. Thus the lower portion 5 of the volume 4 is the major portion of the volume 4.

Figure 8:
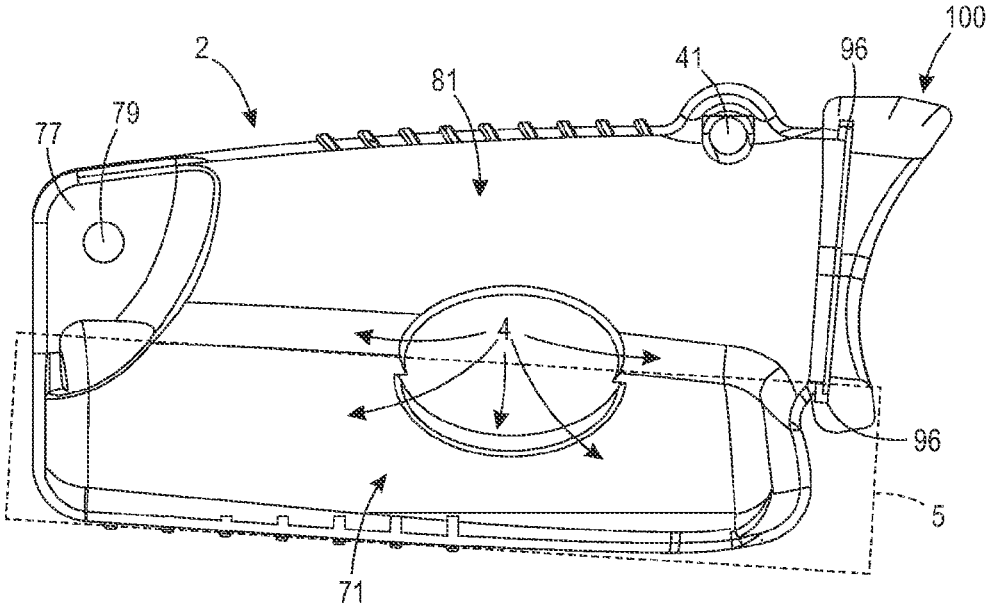
FIG. 8 is a left side cross-sectional view of the urinal of FIG. 1, taken along the line 8-8 of FIG. 3.
Figure 9:
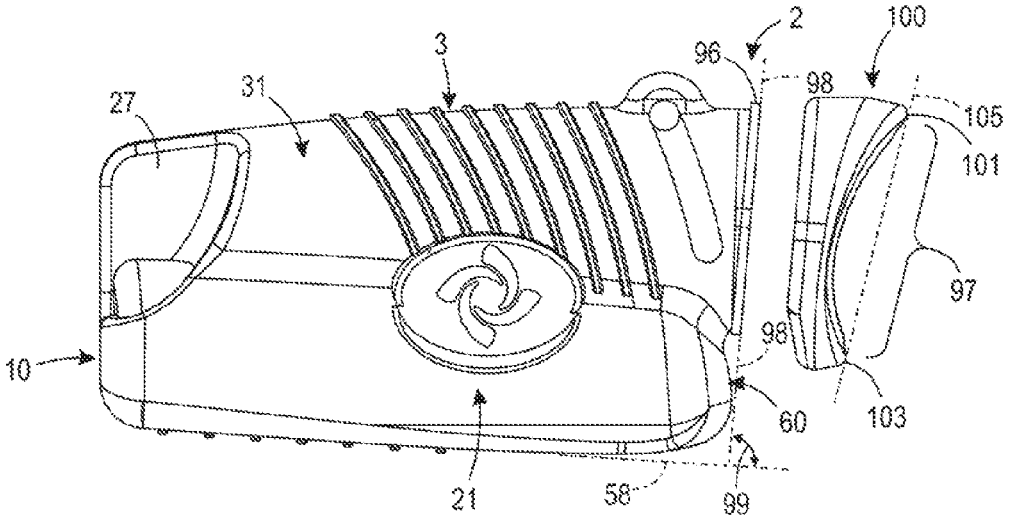
FIG. 9 is an exploded left side elevation view of the urinal of FIG. 1.
Figure 10:
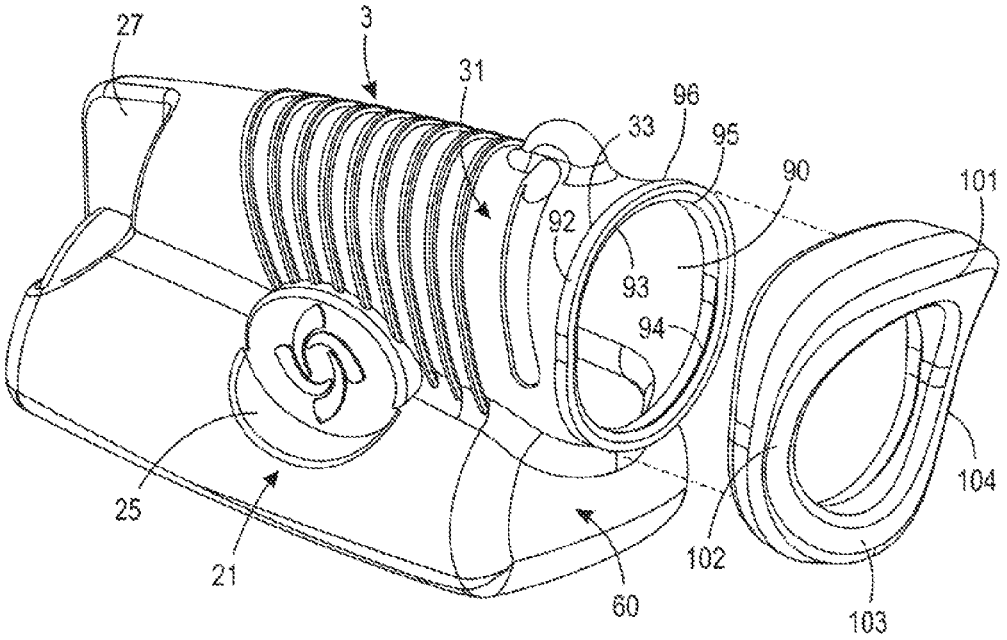
FIG. 10 is an exploded upper left front perspective view of the urinal of FIG. 1.

Referring now to FIGS. 8-10, in certain embodiments, the anterior opening 90 of the urinal may be comprised of a flange 96. In such embodiments, a gasket 100 may be fitted to the flange 96. The gasket 100 may have a convex contour 97 with respect to exterior the urinal 2. The convex contour 97 may be dimensioned to seal against the urethral region of a female human using the urinal 2, as will be described subsequently. In embodiments in which a gasket 100 is not provided, the anterior opening 90 may be comprised of the convex surface 97 integrally formed as part of the urinal body and dimensioned to seal against the urethral region of a female human.

In certain embodiments, the anterior opening 90 of the urinal defines an opening plane 98, which may intersect a bottom plane 58 defined by the bottom wall 50 at an angle 99 of less than 90 degrees. The angle 99 may be between 65 degrees and 90 degrees.

To render the urinal 2 easier to use, the first and second side walls 20 and 70 may each be comprised of a holding feature configured to engage with a human hand. In certain embodiments, the holding features are comprised of a plurality of ribs 36 and 86 (see FIGS. 1, 2, and 5) formed on the respective upper side wall portions 30 and 80 of the first and second side walls 20 and 70. The ribs may be provided at greater or lesser spacing that shown in FIGS. 1, 2, 5, and 7-10. The ribs may have an alignment that differs from the alignment of ribs 36 and 86. Additionally the ribs may be provided in a crisscross pattern, resulting in a knurled surface for gripping the urinal 2.

Alternatively or additionally, a holding feature of the first side wall 20 may be comprised of a recess 25 formed in the lower region 32 of the upper side wall portion 31 and the upper region 24 of the lower side wall portion 21, and a holding feature of the second side wall may be comprised of a recess 75 formed in the lower region 82 of the upper side wall portion 81 and the upper region 74 of the lower side wall portion 71.

Alternatively or additionally, a holding feature of the first side wall 20 may be comprised of a recess 26 formed in a posterior region of the first side wall 20, and a holding feature of the second side wall 70 may be comprised of a recess 76 formed in the posterior region of the second side wall 70.

In certain embodiments (not shown), the urinal 20 may be further comprised a removable cover (not shown) sealingly engageable with the anterior opening 90.

In certain embodiments, the urinal 2 may include regions in the walls thereof that define a measurement volume within the urinal 2. In the embodiments depicted in FIGS. 1-10, the urinal 2 is comprised of respective posterior regions 27 and 77 of the first and second side walls 20 and 70 that define the measurement volume within the urinal. Depending upon the particular measurement application, the posterior regions 27 and 77 may be more closely spaced, or less closely spaced than shown in FIGS. 1-10. In some embodiments, the posterior regions 27 and 77 may be planar regions, which may be parallel to each other.

Figure 2:
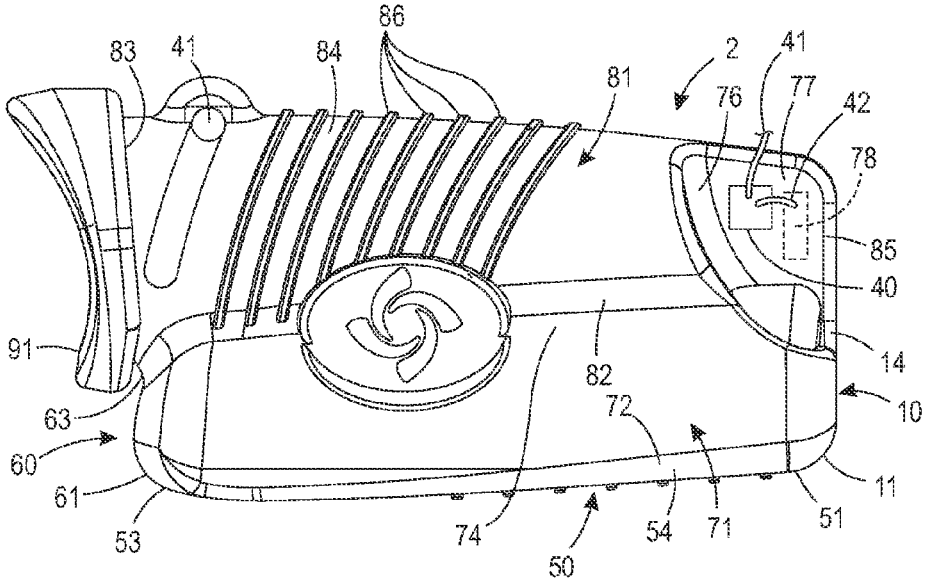
FIG. 2 is a right side elevation view of the urinal of FIG. 1.

In one embodiment depicted in FIGS. 1 and 2, the urinal 2 may include respective electrodes 28 and 78 embedded on the posterior regions 27 and 77. The electrodes may be configured to measure at least one property selected from pH, conductivity, glucose metabolism, and identification of and/or concentration measurement of various natural metabolites, and synthetic metabolite components including drugs and the resulting byproducts of metabolism thereof.

Figure 7:
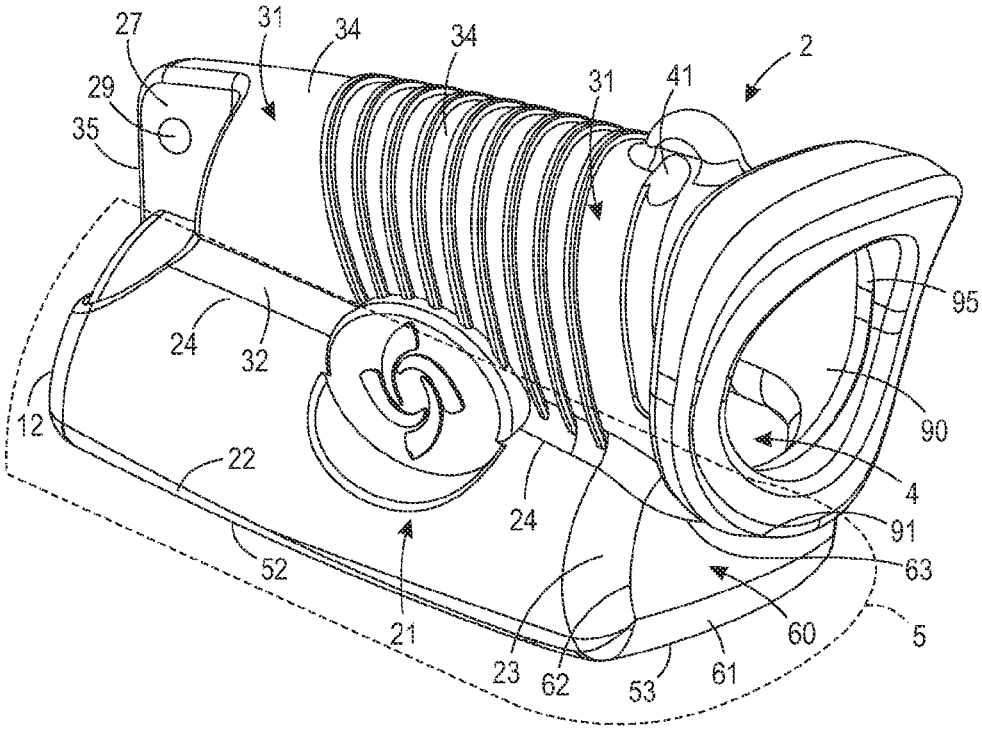
FIG. 7 is an upper left front perspective view of the urinal of FIG. 1.

In another embodiment depicted in FIGS. 7 and 8, the urinal 2 may be further comprised of respective optical windows 29 and 79 disposed in the posterior regions 27 and 77. The optical windows 29 and 79 define an optical path through the measurement volume located between them. The optical windows 27 and 77 may be used for spectroscopic measurements and other optical property measurements of urine contained in the urinal 2. Such measurements may determine the presence and/or concentration of natural and/or synthetic metabolites as described above.

Referring to FIGS. 1 and 2, and in the embodiment depicted therein, the urinal 2 may be further comprised of an electronic chip 40. The chip 40 may be provided with a central processing unit, a memory, a wireless communication circuit, and a data input/output bus. The chip 40 may be receptive of information such as spectroscopic measurement data, and other measurement data. By way of example, electrodes 28 and 78 may be in signal communication with chip 40 though respective wires 41 and 42. The chip 40 may be joined to the surface of the urinal 2, or embedded in a wall of the urinal 2. The chip 40 may be configured to wirelessly communicate urine data and other information to a bedside computer (not shown), or other remote computer system (not shown) via RFID, Bluetooth®, or another suitable communication protocol.

In a further embodiment, the chip 40 may store and communicate patient identifying information, and/or information on the physical location of the urinal 2. This information may be transmitted to the bedside or other computer and correlated with measurement information received and processed by the chip 40. Security measures may be provided in the chip logic so that information can only be sent to an intended recipient.

The urinal 2 may be provided with an eyelet 41 that is suitable for hanging the urinal 2 in storage and/or while it is not in use, or while it contains urine and needs to be emptied. The urinal 2 may be provided with indicia that indicate the volume of urine contained therein. In one embodiment, the indicia may be a series of spaced ribs 55 or notches formed in the bottom wall 50, such that when the urinal 2 is stood on its posterior wall 10 on a flat surface, and is made of a transparent or translucent material so that the level of the urine can be seen through the bottom wall 50, the volume of urine contained therein can be read from the position of the level of urine relative to the ribs 55.

In another embodiment (not shown), the urinal may be further configured to hold in place a sterile bag for clean catch procedures. In such an embodiment, the bag is comprised of tabs configured for unsterile hands to grasp for placement of the bag into the urinal. The top of the bag is then unfurled, like petals of a flower. The "petals" or flaps are then placed over the edge of the opening 90 of the urinal so that the entire human and urine contact area is on the inside of the bag and not touched by a caregiver doing the set up. Once the urine is captured, the flaps can be pulled together and secured by suitable means. The tabs and extra flaps can be then cut off. This embodiment can be used with females in various positions including supine and sitting.

The urinal 2 may be made of any suitable material that is resistant to chemical attack by the constituents of urine, such as thin-walled stainless steel or plastic. In one embodiment, the body 3 of the urinal may be made of polypropylene, which may be molded as a single unitary piece. The gasket 100 may be made of a compliant elastomer such as silicone elastomer, or a gel polymer such as one of the Versaflex™ Thermoplastic Elastomers manufactured and sold by the PolyOne Corporation of McHenry, Ill. The gasket 100 may be made of closed-cell polymer foam.

In one exemplary embodiment, a urinal 2 was fabricated with a length from posterior wall 10 to anterior wall 60 of about 6.8 inches; a lower side wall width from the outermost region of the lower side wall portion 21 of the first side wall 20 to the outermost region of the lower side wall portion 71 of the second side wall 70 of about 3.1 inches; an upper side wall width from lower region 32 of the upper side wall portion 31 of the first side wall 20 to the lower region 82 of the upper side wall portion 81 of the second side wall 70 of about 2.0 inches; and a height from the bottom wall 50 to the junction of the first and second side walls 20 and 70 proximate the eyelet 41 of about 3.9 inches. This prototype urinal 2 had a major volume 5 of about 20 ounces, and an effective useful volume, i.e. a volume in which the urinal is not so full as to risk spillage by the user, of about 16 ounces. Given that the average volume of urine expressed by a user during micturition is 8 ounces, with a typical range of 2 to 12 ounces, this capacity is effective for use in almost all circumstances.

Use of the urinal 2 by a female human, and certain advantages of the urinal 2 will now be described, with reference in particular to FIGS. 11A-12B.

Figure 11A:
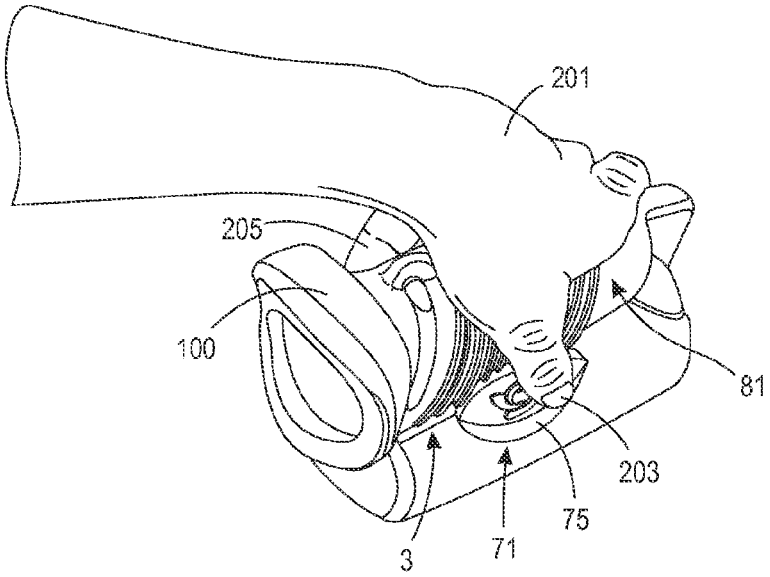
FIG. 11A is a perspective view of a user holding the urinal of FIG. 1 according to a first technique.
Figure 12A:
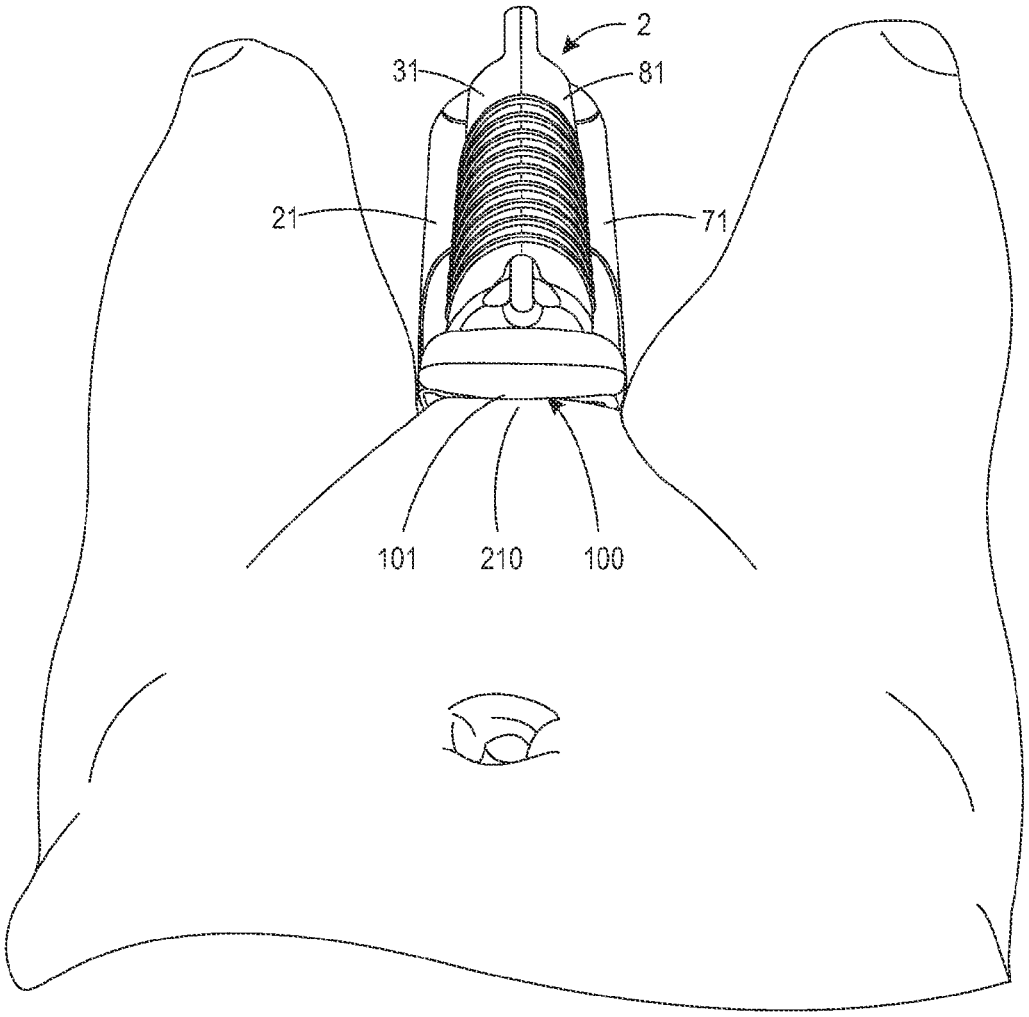
FIG. 12A is an upper perspective view of a user using the urinal of FIG. 1.
Figure 12B:
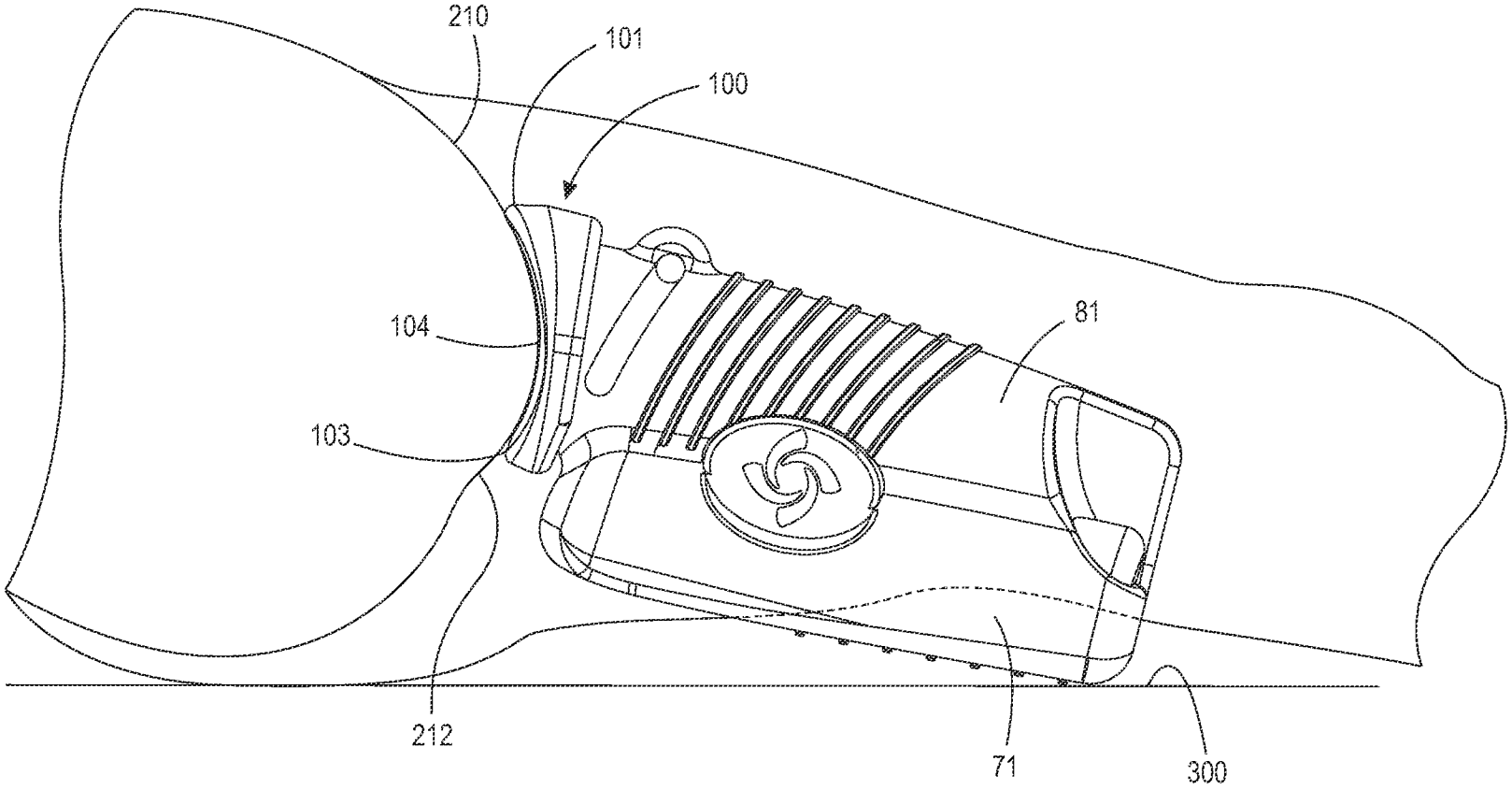
FIG. 12B is a cutaway side elevation view of a user using the urinal of FIG. 1.

Referring first to FIG. 11A, a user may use the urinal 2 by gripping it from above with a single hand 201 and positioning it as shown in FIGS. 12A and 12B. In FIG. 11A, a left-hand 201 is shown gripping the urinal 2. The thumb 203 of the hand 201 may engage with recess 75 in the side wall 81, while the fingers 205 grip the opposite upper side wall 31 and recess 25. The ribs 36/86 on the upper side walls 31/81 provide additional stability to the user's grip on the urinal 2 when in use.

Figure 11B:
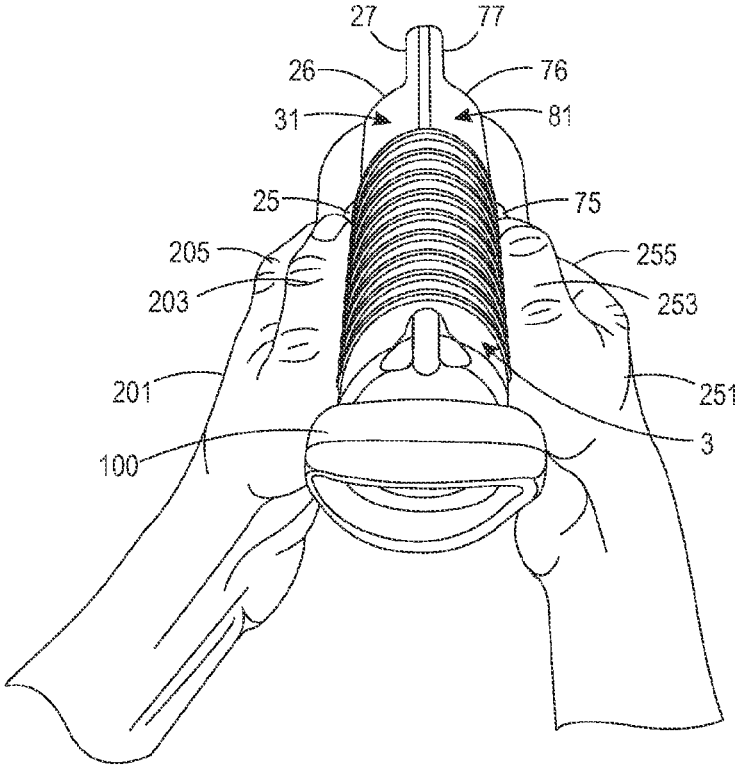
FIG. 11B is a perspective view of a user holding the urinal of FIG. 1 according to a second technique.

Referring now to FIG. 11B, a two-handed grip along the side walls 31 and 81 of the urinal 2 is shown. The user's left hand 201 grips the left side of the urinal 2, with the thumb 203 engaged with recess 25, and the fingers 205 extending downwardly along the lower side wall portion 21, and onto a left portion of the bottom wall 50. In like manner, the user's right hand 251 grips the right side of the urinal 2, with the thumb 253 engaged with recess 75, and the fingers 255 extending downwardly along the lower side wall portion 71, and onto a right portion of the bottom wall 50. The thumbs 203 and 253 may also engage with the respective ribs 36 and 86, thereby providing additional stability to the user's grip on the urinal 2 when in use. In an alternative method of gripping (not shown), the users fingers 205 and 255 may extend longitudinally, engaging with the respective recesses 26 and 76, with the thumbs 203 and 253 placed parallel to each other or crossed over each other and in contact with the ribs 36 and 86.

Advantageously, the methods of gripping provide superior results as compared to prior art urinals know to the Applicant that include handles for gripping. During placement and use of such urinals, the handle is not in an ergonomically desirable location. By holding the handle, the wrist of the user must be in extreme ulnar deviation. The tendency is to lift back, and toward the body to reposition the wrist in neutral, relieving the strain. This movement tips the head and inlet of the urinal down, leading to spills of urine.

Referring now to FIGS. 12A and 12B, the urinal 2 is shown in use by a patient. For the sake of simplicity of illustration, the user's hands are not shown, with it being understood that the urinal may be gripped as described above, or by other gripping methods. With the user lying in the supine position, with legs slightly abducted, the urinal 2 is positioned with the upper portion 101 of the gasket 100 firmly against the mons area or pubic bone 210 of the user, which is a consistent "landmark" and enables reliable and confident use. The user then pivots the posterior end of the urinal 2 downwardly such that the side portions 102 and 104 of the gasket 100 seal against the respective regions between the uppermost portion of the thighs and the urethra, and the lower region 103 of the gasket seals against the perineum region of the user. Advantageously, with the urinal 2 being provided with an acute angle between the plane 98 of the opening 90 and the plane 58 of the bottom wall 50 as described previously, the urinal 2 can be tilted downwardly beyond a substantially horizontal position as shown in FIG. 12B without being blocked by contact with a mattress 300, such that a firm seal of the gasket 100 against the user is attained, and such that the user can sense the firmness of the seal and use the urinal 2 with confidence that no leakage will occur. Additionally, with the gasket being formed of a soft, compliant elastomer, the fit of the gasket is comfortable, and post urination, the urinal 2 can be swiped upward, thereby catching any remaining drips.

In one exemplary embodiment, the shape of the opening 90 is about 3 inches high by 3 inches wide. This shape enables a comfortable and effective sealing fit within the periurethal area of the user while advantageously not requiring a large degree of leg abduction, which is sometimes not possible with bedbound users. With the upper portion of the urinal 2 bounded by upper wall portions 31 and 81 being relatively narrow, the user does not need to engage in a widely abducted leg position during use, with the urinal 2 having sufficient capacity by virtue of its more widely spaced lower wall portions 21 and 71, which are located beneath the thighs during use.

Figure 3:
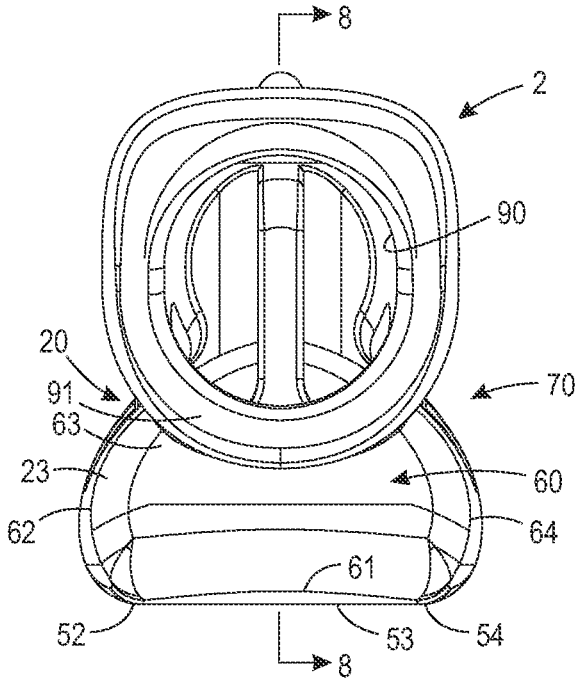
FIG. 3 is front elevation view of the urinal of FIG. 1.
Figure 4:
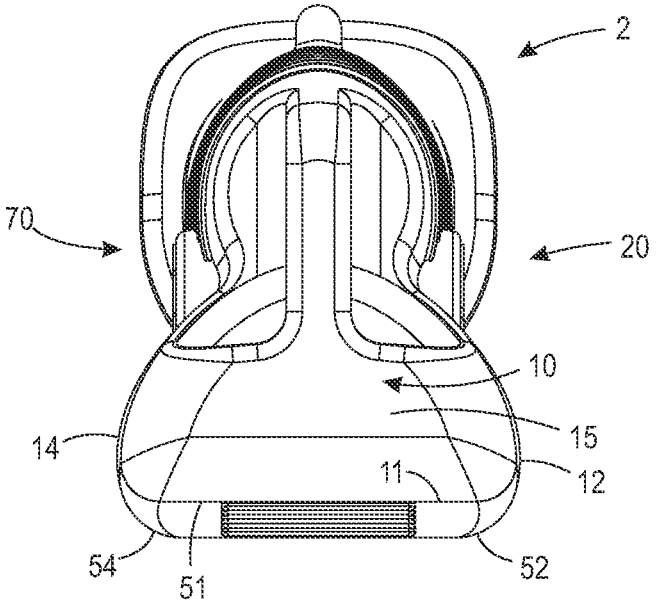
FIG. 4 is a rear elevation view of the urinal of FIG. 1.
Figure 5:
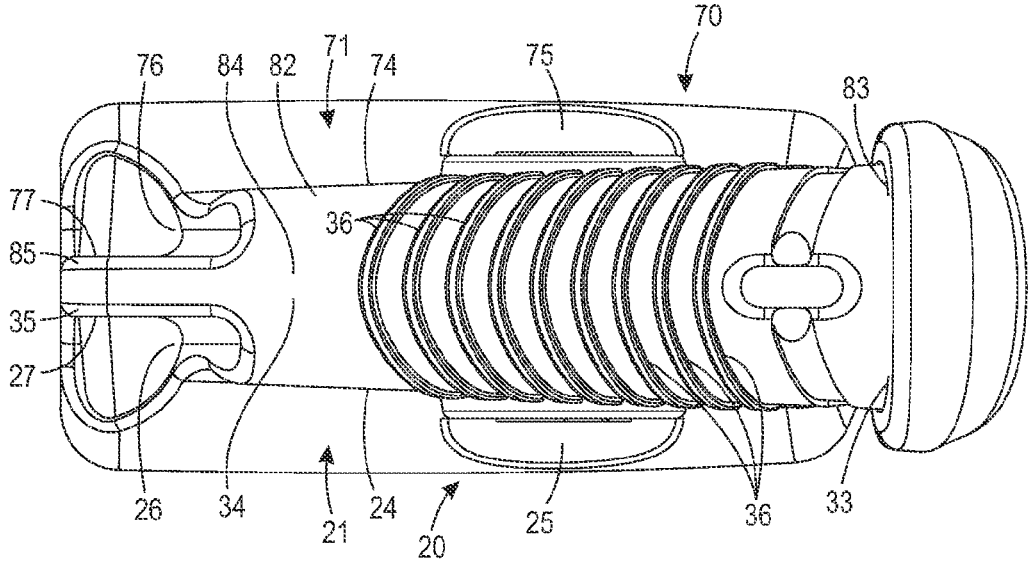
FIG. 5 is a top view of the urinal of FIG. 1.
Figure 6:
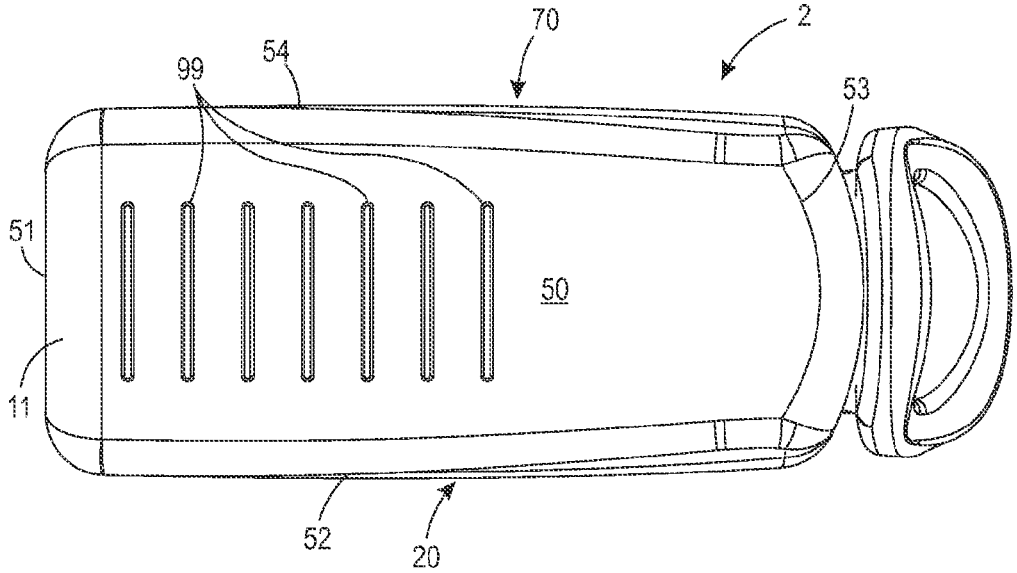
FIG. 6 is a bottom view of the urinal of FIG. 1.

Additionally, in the embodiment depicted in FIGS. 1-12B, and referring in particular to FIG. 9, the upper and lower portions 101 and 103 define a second plane 105 of the opening that is at about a 10 degree angle with the first plane 98 of the opening. In other words, the upper region 101 protrudes slightly beyond the lower region 103 of the opening 100. Additionally, the upper region 101 is also slightly bulkier than the lower region 103, as can be seen in FIG. 3. Advantageously, this enables the urinal 2 to be placed in the optimum position for coverage of the urethra, and also allows for the slope needed for urine flow into the chamber. In contrast, many prior art urinals known to the applicant, when in contact with the body, require urine to flow vertically, up into the collection chamber. Thus even if a good seal of such a urinal to the user's body is attained, leakage and spillage often result when the urinal is removed from contact with the body.

It was noted previously that in one exemplary embodiment, a urinal 2 may be provided with about 16 ounces of capacity, and that given that the average volume of urine expressed by a user during micturition is 8 ounces, this capacity is effective for use in almost all circumstances. In the event that additional volume is needed, the length of the urinal 2 may be increased to add capacity. Additionally, the angle 99 between the plane 98 of the opening 90 and the plane 58 of the bottom wall 50 may be decreased, so as to maintain the ability to tilt the urinal 2 downwardly when in use as described previously and shown in FIG. 12B.

It is, therefore, apparent that there has been provided, in accordance with the present invention, a urinal for use by a human patient. In particular, the urinal is effective for a pregnant, injured, or sick woman to use independently while lying supine in bed in a variety of settings. The urinal may increase independence of a bedbound female during micturition. Having thus described the basic concept of the invention, it will be rather apparent to those skilled in the art that the foregoing detailed disclosure is intended to be presented by way of example only, and is not limiting. Various alterations, improvements, and modifications will occur to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims.

I claim:

1. A urinal enclosing a volume for receiving urine and comprising:

a) a bottom wall having a perimeter defining a bottom wall plane, the perimeter comprising a posterior part, opposed first and second side parts, and an anterior part opposed to the posterior part in an anterior direction;

b) a posterior wall including a bottom edge contiguous with the posterior part of the perimeter of the bottom wall and opposed first and second side edges;

c) an anterior wall including a bottom edge contiguous with the anterior part of the perimeter of the bottom wall, opposed first and second side edges, and an upper region proximate to a lower portion of an anterior opening, the lower portion and an upper portion of the anterior opening defining an anterior opening plane canted in the anterior direction at an acute angle with respect to the bottom wall plane;

d) a first side wall comprised of:

i) a lower side wall portion including a bottom edge contiguous with the first side part of the perimeter of the bottom wall, an upper region, and an anterior edge contiguous with the first side edge of the anterior wall;

ii) an upper side wall portion, including a lower region contiguous with the upper region of the lower side wall portion of the first side wall, a top region, and an anterior edge forming a first side and top portion of the anterior opening; and iii) a posterior edge contiguous with the first side edge of the posterior wall; and e) a second side wall opposed to the first side wall and comprised of:

i) a lower side wall portion including a bottom edge contiguous with the second side part of the perimeter of the bottom wall, an upper region, and an anterior edge contiguous with the second side edge of the anterior wall;

ii) an upper side wall portion, including a lower region contiguous with the upper region of the lower side wall portion of the second side wall, a top region, and an anterior edge forming a second side and top portion of the anterior opening; and iii) a posterior edge contiguous with the second side edge of the posterior wall.

2. The urinal of claim 1, wherein the bottom wall, lower side wall portion of the first side wall, lower side wall portion of the second side wall, anterior wall, and a lower portion of the posterior wall define a major portion of the volume of the urinal.

3. The urinal of claim 2, wherein the major portion of the volume of the urinal is at least 60 percent of the volume of the urinal.

4. The urinal of claim 1, wherein the lower side wall portion of the first side wall extends laterally outwardly from the lower region of the upper side wall portion of the first side wall, and the lower side wall portion of the second side wall extends laterally outwardly from the lower region of the upper side wall portion of the second side wall.

5. The urinal of claim 1, wherein the anterior opening is surrounded by a flange defining a flange opening plane.

6. The urinal of claim 5, further comprising a gasket fitted to the flange and comprising a lower portion of a first thickness, first and second side portions, and an upper portion of a second thickness greater than the first thickness of the lower portion, wherein the upper and lower portion of the gasket define a gasket opening plane canted in the anterior direction at an acute angle with respect to the bottom wall plane.

7. The urinal of claim 6, wherein the gasket has a convex contour with respect to exterior the urinal.

8. The urinal of claim 7, wherein the convex contour of the gasket is dimensioned to seal against the urethral region of a female human.

9. The urinal of claim 6, wherein the gasket opening plane is canted in the anterior direction at an acute angle with respect to the anterior opening plane.

10. The urinal of claim 1, wherein the anterior opening is comprised of a convex surface dimensioned to seal against the urethral region of a female human.

11. The urinal of claim 1, wherein the first and second side walls are each comprised of a holding feature configured to engage with a human hand.

12. The urinal of claim 11, wherein the holding features are comprised of a plurality of ribs formed on the upper side wall portions of the first and second side walls.

13. The urinal of claim 11, wherein the holding feature of the first side wall is comprised of a recess formed in the lower region of the upper side wall portion of the first side wall and the upper region of the lower side wall portion of the first side wall, and the holding feature of the second side wall is comprised of a recess formed in the lower region of the upper side wall portion of the second side wall and the upper region of the lower side wall portion of the second side wall.

14. The urinal of claim 11, wherein the holding feature of the first side wall is comprised of a recess formed in a posterior region of the first side wall, and the holding feature of the second side wall is comprised of a recess formed in a posterior region of the second side wall.

15. The urinal of claim 1, further comprising a removable cover sealingly engageable with the anterior opening.

* * * * *